US006471311B1

(12) United States Patent
Snyder

(10) Patent No.: US 6,471,311 B1
(45) Date of Patent: Oct. 29, 2002

(54) CABINET WITH DOWNWARD EXTENDABLE/RETRACTABLE SHELVES

(76) Inventor: David E. Snyder, 3602 W. Behrend Dr., Glendale, AZ (US) 85308

( * ) Notice: Subject to any disclaimer, the term of this patent is extended or adjusted under 35 U.S.C. 154(b) by 0 days.

(21) Appl. No.: 09/802,304

(22) Filed: Mar. 9, 2001

Related U.S. Application Data

(63) Continuation-in-part of application No. 09/318,160, filed on May 25, 1999, now Pat. No. 6,336,692.

(51) Int. Cl.[7] ..... A47F 5/08
(52) U.S. Cl. ..... 312/247; 312/245; 312/312
(58) Field of Search ..... 312/245, 246, 312/247, 306, 312, 319.5, 319.8, 242, 248, 294

(56) References Cited

U.S. PATENT DOCUMENTS 2,382,354 A * 8/1945 Wales ..... 312/247
2,854,307 A * 9/1958 Londeree et al. ..... 312/247
2,944,540 A * 7/1960 Littell, Jr. ..... 312/247 X
3,285,682 A * 11/1966 Nelson ..... 312/247 X
4,915,461 A * 4/1990 Kingsborough et al. .... 312/247
5,484,196 A * 1/1996 Kim ..... 312/242
5,754,999 A * 5/1998 Helmsderfer ..... 312/248 X
5,857,756 A * 1/1999 Fehre ..... 312/246

FOREIGN PATENT DOCUMENTS

DE 3409990 * 7/1984 ..... 312/247

* cited by examiner

*Primary Examiner*—James O. Hansen
(74) *Attorney, Agent, or Firm*—Jeffrey D. Moy; Harry M. Weiss; Weiss, Moy & Harris, PC

(57) ABSTRACT

A downward extendable and retractable shelving system has a cabinet assembly. A support panel is coupled to a wall from which the system is to be mounted. The support panel is used for mounting the cabinet to the wall. An extendable and retractable mechanism is coupled to the cabinet and to the support panel for lowering and raising the cabinet.

16 Claims, 6 Drawing Sheets

CABINET WITH DOWNWARD EXTENDABLE/RETRACTABLE SHELVES

RELATED APPLICATIONS

This application is a continuation-in-part of Ser. No. 09/318,160 filed May 25, 1999, now U.S. Pat. No. 6,336,692, entitled "CABINET WITH DOWNWARD EXTENDABLE/RETRACTABLE SHELVES," filed on May 25, 1999, in the name of the same inventor and is hereby incorporated by reference into the present application.

BACKGROUND OF THE INVENTION

1. Field of the Invention

The present invention relates to cabinets and in particular to a cabinet mountable to a ceiling or wall having shelving assembly that are downwardly extendable and retractable.

2. Description of the Prior Art

Conventional cabinets of the type that are usually found mounted to walls have a front panel with doors that open to permit access to the interior of the cabinet. Disposed in the interior are usually a plurality of shelves starting from the lowest shelf to the highest. A disadvantage to these types of cabinets is that the accessibility to the top shelves and in particular the rear portion of the top shelves, can be difficult. Oftentimes, stools or ladders must be used to reach these shelves. Using stools and ladders not only creates the risk of falling, but may not be practical where space is limited. For a physically challenged person, such as a person confined to a wheelchair, access to the top shelves is even more difficult.

Accordingly, a need exists for a wall or ceiling mountable cabinet where all the shelves are easily accessible without the need for a ladder or stool.

SUMMARY OF THE INVENTION

An object of the present invention is to provide a wall or ceiling mountable cabinet where all the shelves are easily accessible.

Another object of the present invention is to provide a wall or ceiling mountable cabinet having shelves easily accessible to a person who is physically challenged.

BRIEF DESCRIPTION OF THE PREFERRED EMBODIMENTS

The present invention accomplishes the above objects by providing a cabinet having a shelving assembly that can be extended downward when access is required and then retracted upward when access is no longer required. The cabinet includes a housing having an open bottom. Disposed within the housing is a shelving assembly having a plurality of shelves. A novel combination of a tension gas spring and telescoping drawer glides are used for mounting the shelving assembly to the housing. When items are needed from the cabinet, the shelving is pulled down until all the shelves are exposed. When access is no longer needed, a light tap to the bottom of the shelving assembly causes the tension gas spring to smoothly retract the shelving assembly back into the housing.

In accordance with another embodiment of the present invention, a downward extendable and retractable shelving system is disclosed. The system has a cabinet assembly. A support panel is coupled to a wall from which the system is to be mounted. The support panel is used for mounting the cabinet to the wall. An extendable and retractable mechanism is coupled to the cabinet and to the support panel for lowering and raising the cabinet.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENT

Figure 1:
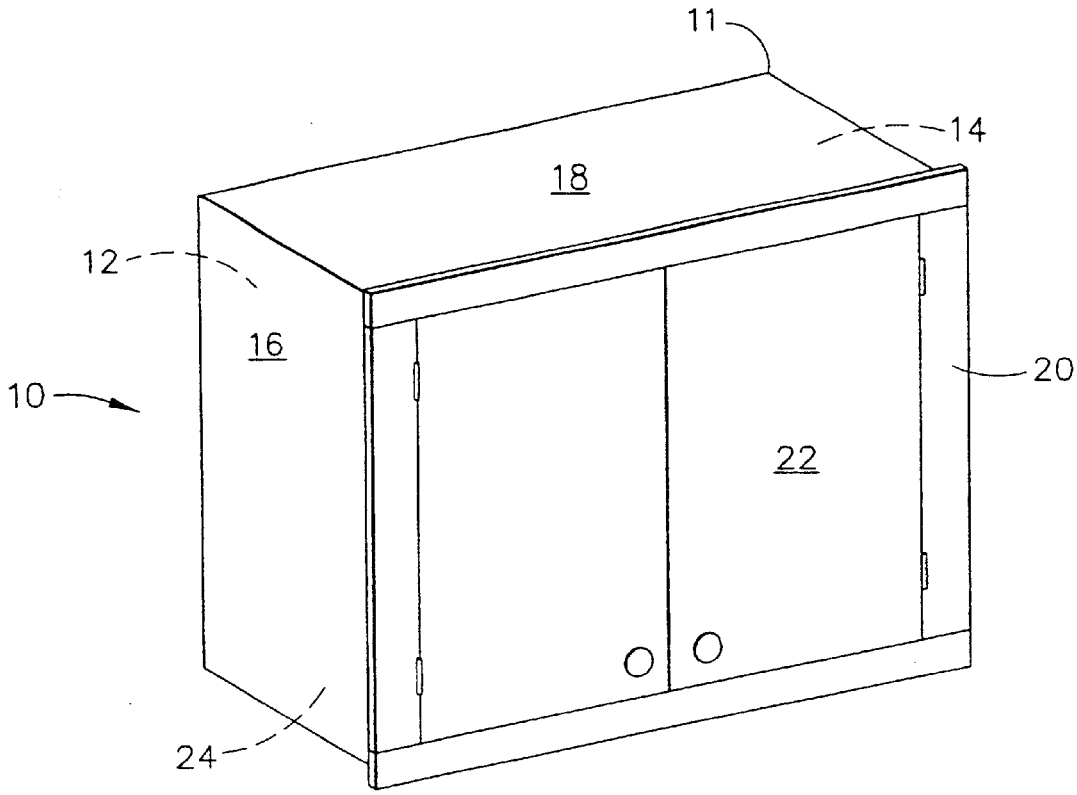
FIG. 1 is a perspective view of a wall or ceiling mountable cabinet contemplated by the present invention.
Figure 2:
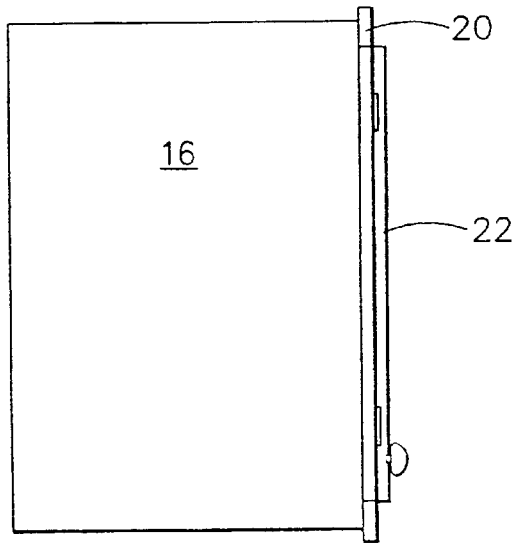
FIG. 2 is a side view of the cabinet of FIG. 1.
Figure 5:
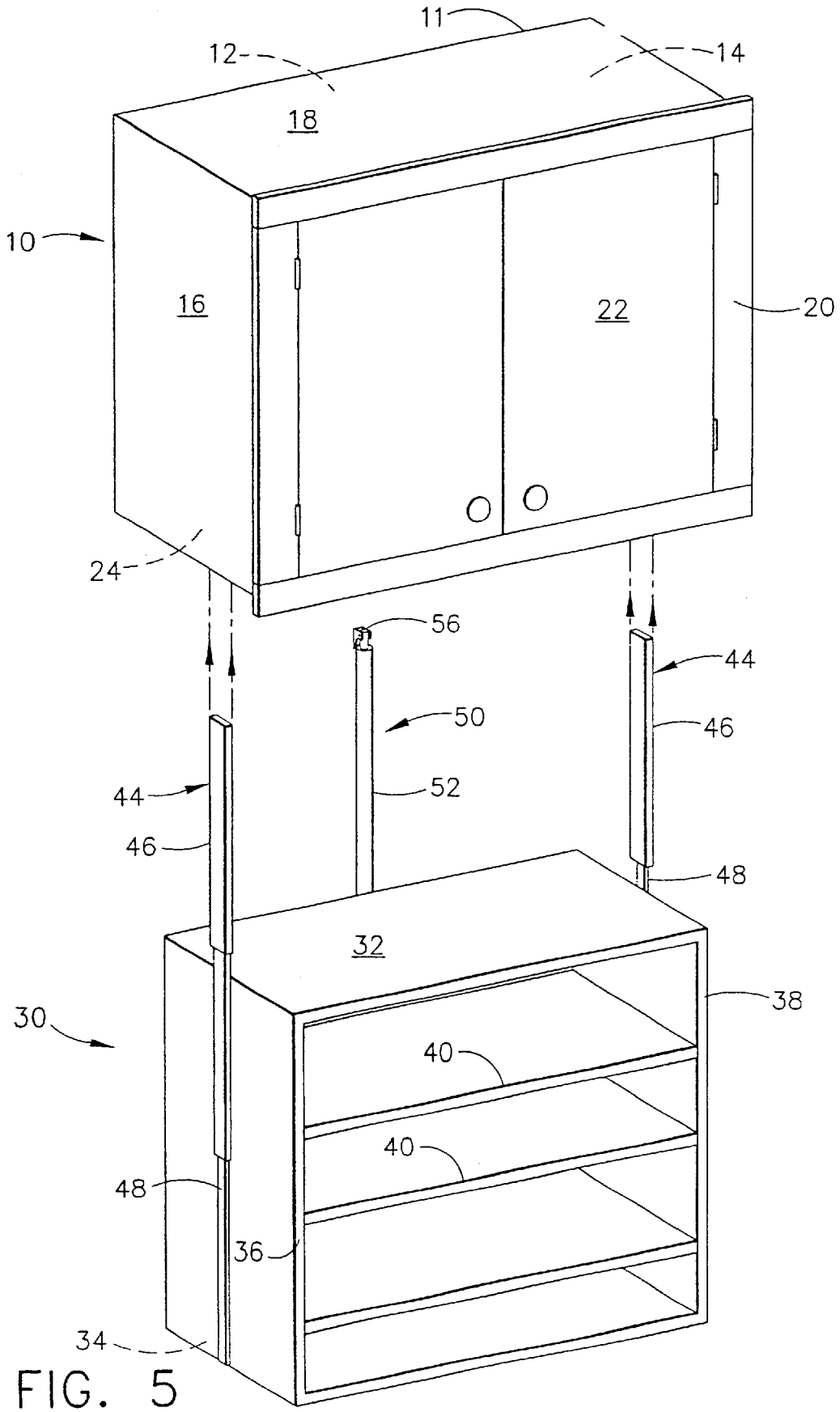
FIG. 5 is an exploded perspective view of a wall or ceiling mountable cabinet with downward extendable/retractable shelving assembly contemplated by the present invention.

Referring to the drawings, FIGS. 1, 2 and 5 show a cabinet generally denoted by reference numeral 10. The cabinet 10 has a housing 11 comprising a back panel 12, side panels 14 and 16, a top panel 18 and a front border referred to as a face frame 20 that defines an opening into the interior of the housing 11 This opening is covered by a door 22 that is hinged to the border 20. Alternatively, the door 22 can be replaced with a front panel. The bottom edges of the back panel 12, side panels 14 and 16 and the face frame 20 define a bottom opening 24.

Figure 3:
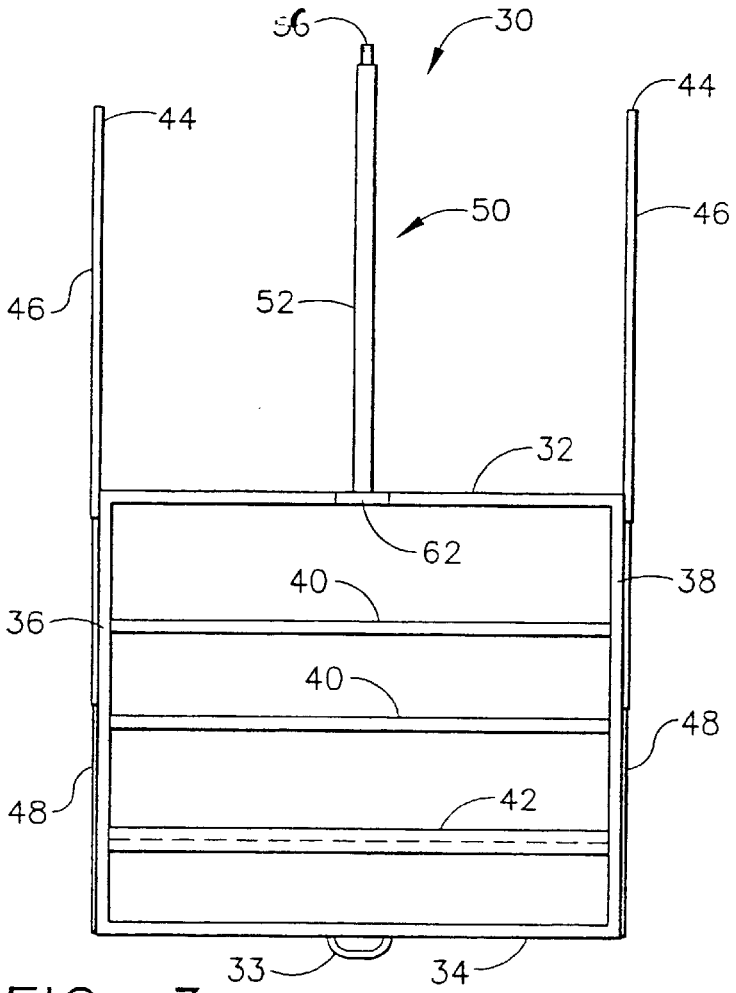
FIG. 3 is a front view of the shelving assembly of the cabinet of FIG 1.
Figure 4:
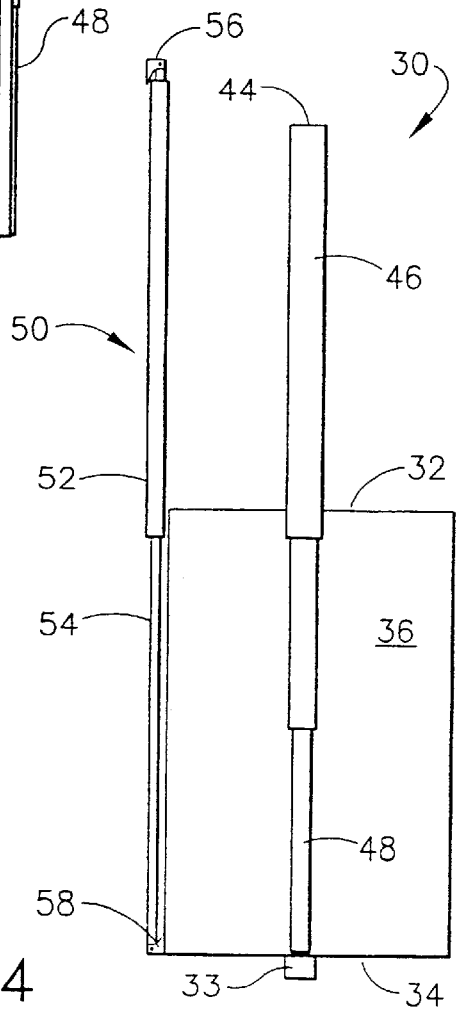
FIG. 4 a side view of the shelving assembly of FIG. 3.

Disposed in the interior of the housing 11 is a shelving assembly generally denoted by reference numeral 30. With reference to FIGS. 3, 4 and 5 the shelving assembly 30 comprises a top and bottom wall 32 and 34, side walls 36 and 38 and shelves 40. A handle 33 extends downward from the bottom wall 34. The position of the shelves 40 can be adjusted in a manner familiar to those skilled in the art. Optionally, the shelving assembly 30 may also have a back panel. Also, some of the shelves may have an upwardly extending lip 42 to keep items stored on the shelves from sliding off.

Conventional telescoping drawer glides 44 are used to couple the shelving assembly 30 to the housing 11. Each of the glides 44 has a first portion 46 that is mounted to one of the walls 14,16 and a second portion 48 that is mounted to one of the side walls 36, 38 respectively. In the preferred embodiment, a commercially available tension gas spring 50 has a cylinder 52 and a rod portion 54 that is mounted within the cylinder 52 and is extendable therefrom. The cylinder 52 is mounted to the back panel 12 by a pin and U-bracket 56 and the rod portion 54 is attached to the rear edge of the bottom wall 34 or the back panel by a pin and U-bracket 58 or other type of bracket such as a post style bracket or an eye rod end. A U-shaped guide 60, (see FIG. 7), is also mounted to the back panel 12 and is positioned to receive the cylinder 52 at an end opposite the end having the U-bracket 56. This U-shaped guide 60 provides lateral stability to the gas spring 50.

Figure 6:
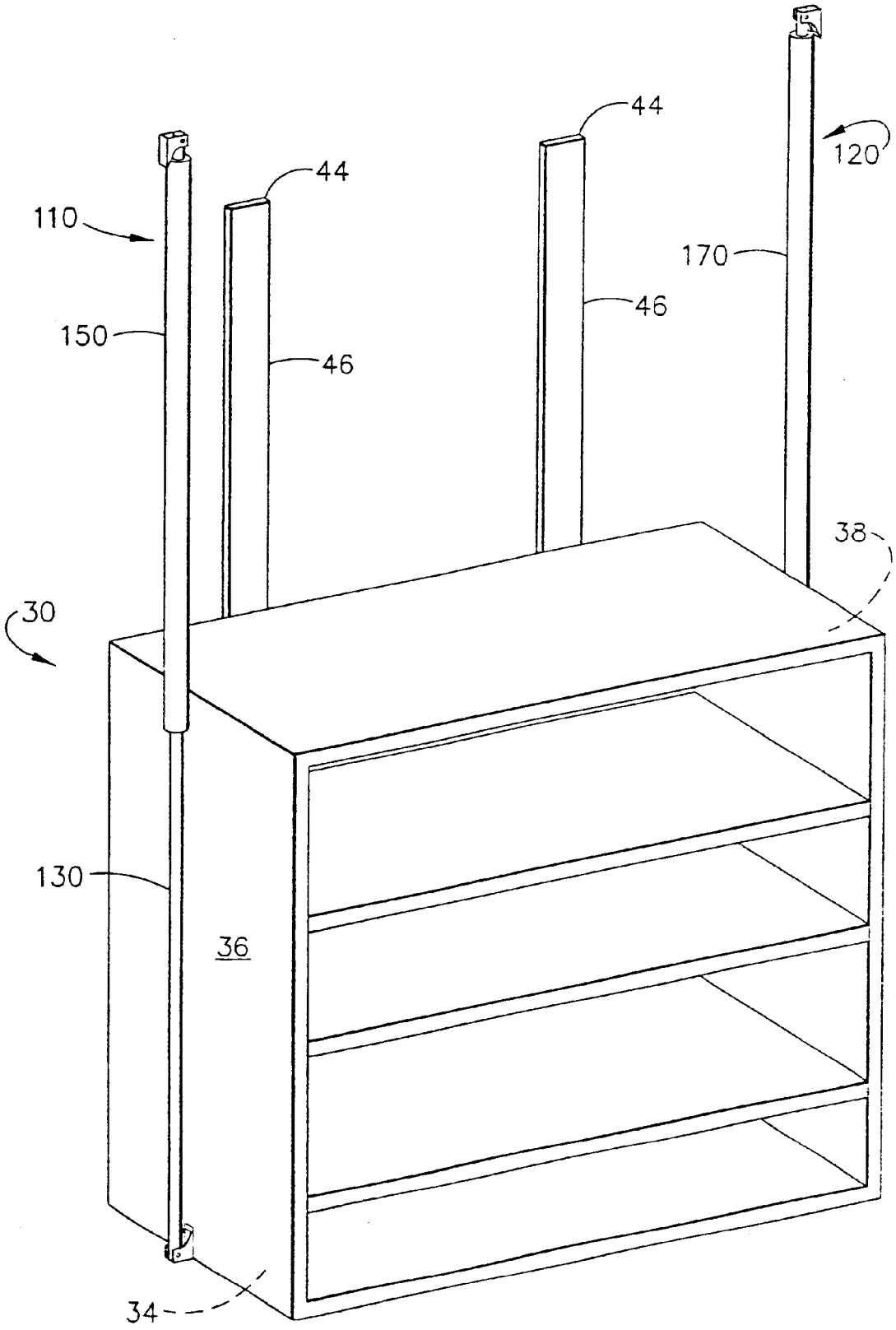
FIG. 6 is a perspective view of an alternative embodiment shelving assembly of the cabinet of FIG. 1.

In an alternative embodiment, as shown in FIG. 6, shelving assembly 30 employs two gas springs 110, 120 instead of one. In this embodiment, rod portion 130 of spring 110 is attached to side wall 36 or a side edge of bottom wall 34 proximal side wall 36 and the cylinder 150 of spring 110 is mounted to side panel 16, each in a manner similar to that described above. In similar fashion, rod portion (not shown) of spring 120 is attached to side wall 38 or a side edge of bottom wall 34 proximal side wall 38 and the cylinder 170 of spring 120 is mounted to side panel 14. First portions 46 of glides 44 are mounted to back panel 12 and second portions 48 are mounted to the rear edge of bottom wall 34 or the back panel, each in a manner similar to that described above. Such an arrangement prevents the shelving assembly 100 from twisting. In either embodiment, the point of attachment of the cylinder and rod portion of springs 50, 110, 120 can be reversed. That is, the cylinder can be attached to the bottom wall 34 and the rod portion to the top back panel 12 or side panels 14, 16.

Figure 7:
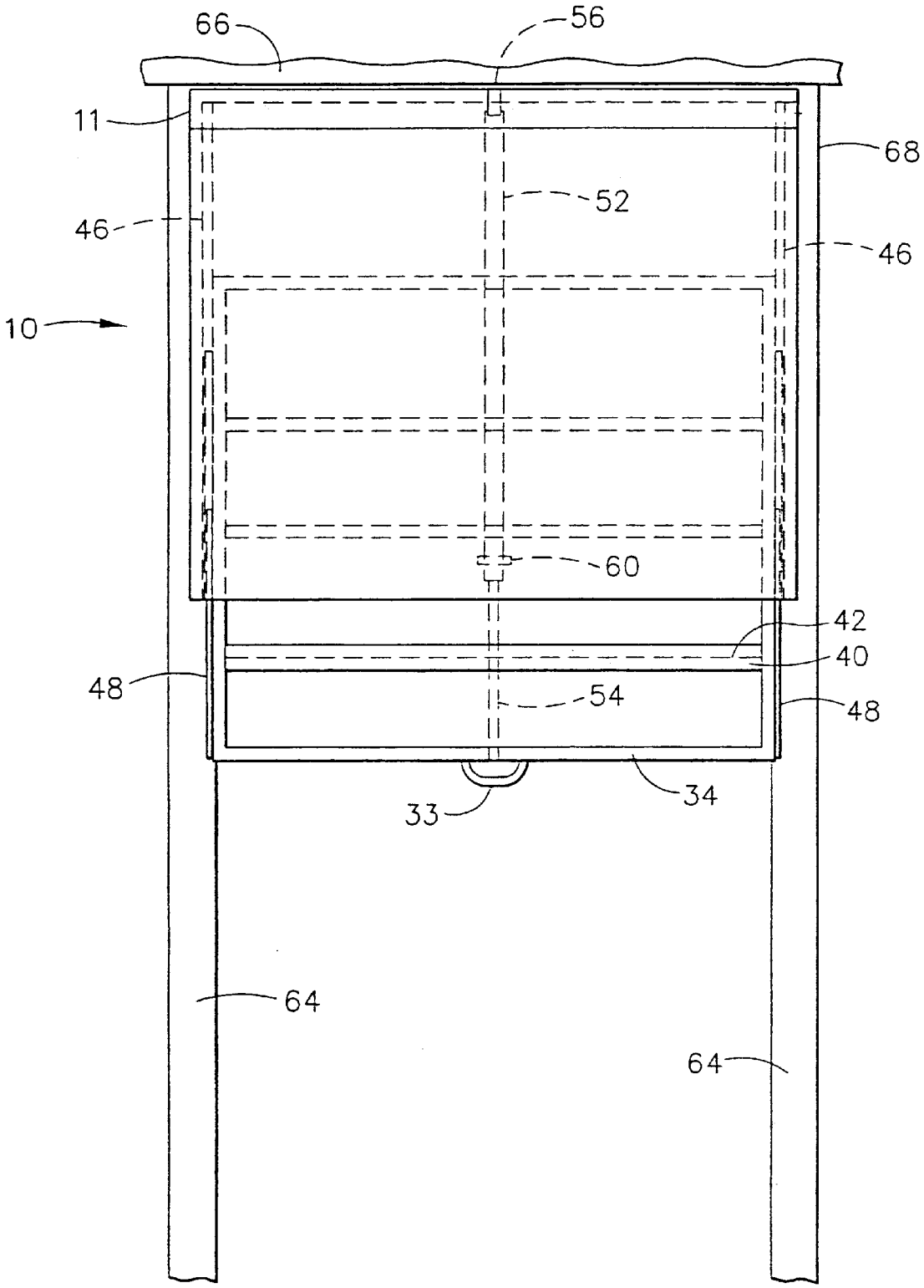
FIG. 7 is a front view of the cabinet of FIG. 1 mounted to a ceiling and showing the internal structure with dashed lines.

Referring to FIG. 7, the cabinet 10 is mounted to studs 64 in a wall just below a ceiling 66. A french cleat fastener 68 is the preferred method of mounting the cabinet to the wall. Alternatively, the cabinet can be screwed into the studs. For aesthetic purposes, a cornice or molding, not shown, is disposed between the cabinet and the ceiling. When items are needed from the cabinet, the handle 33 is grasped and the shelves 40 are pulled down until the telescoping portions 48 of the glides 44 are fully extended. In this extended position, the shelves 40 are easily accessible. The shelves will stay fully extended, until by applying a light tap to the bottom wall 34 the tension spring 50 will cause the rod portion 54 to retract until all the shelves 40 are fully retracted back into the cabinet housing 11. To avoid accidental retraction caused by an inadvertent tap, a variety of latching devices can be used to hold the shelves 40 in their extended position. In the preferred embodiment, a magnet 62 (see FIG. 3) is mounted on the front edge of the top wall 32 and is positioned equidistant from walls 36 and 38. A corresponding magnet, (not shown), is mounted on the inside of the upper edge of the front border 20 and is positioned so that when the shelves 40 are fully extended downward, this magnet and magnet 62 form a magnetic latch. Thus, the shelves will not retract until a sufficient force is applied to break this magnetic latch.

Figure 8:
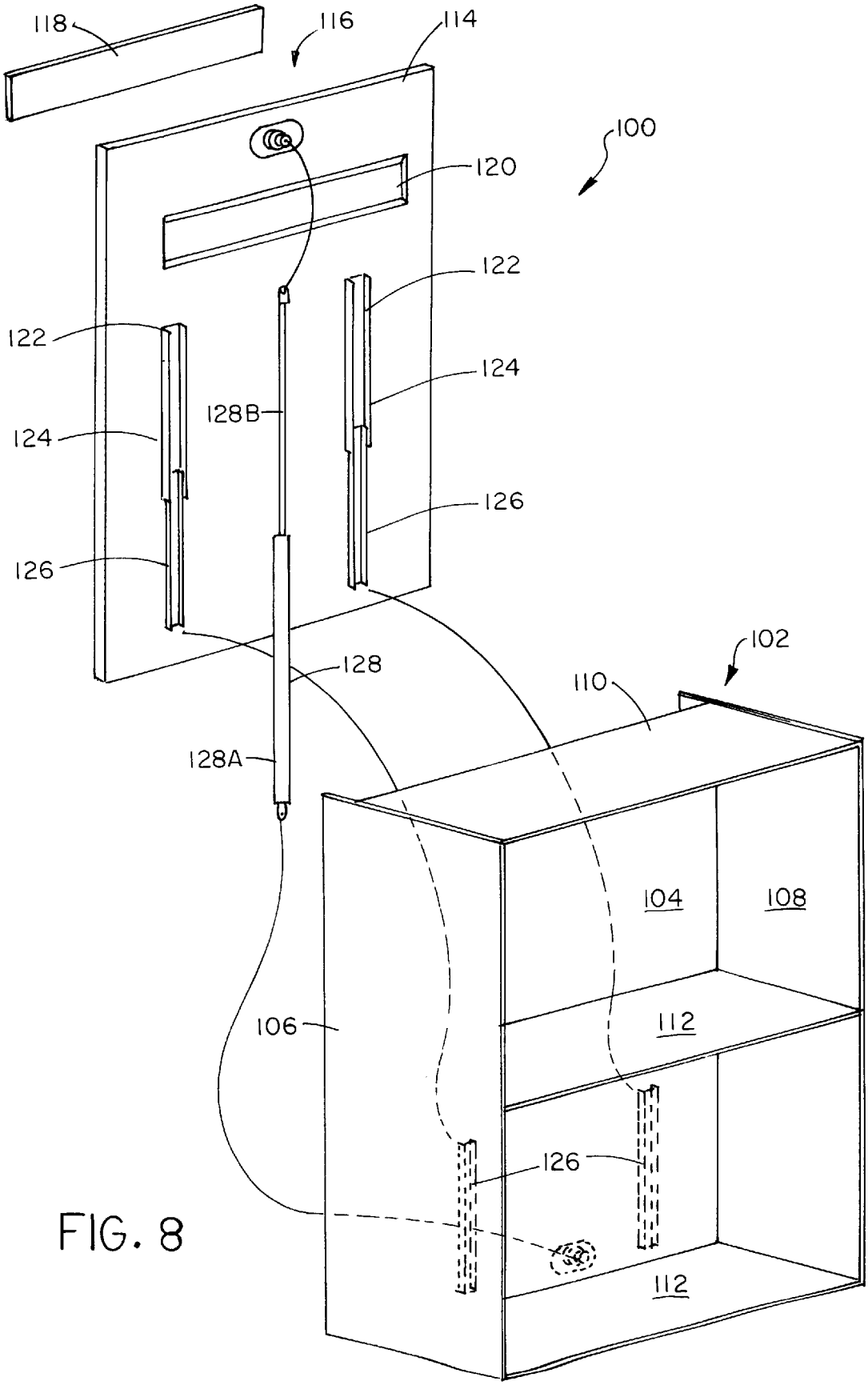
FIG. 8 is a perspective view of another embodiment of the wall or ceiling mountable cabinet of the present invention

Referring to FIG. 8, another embodiment of the extendable/retractable shelving assembly 100 (hereinafter assembly 100) is shown. In this embodiment, the extendable/retractable shelving assembly 100 also has a cabinet 102. The cabinet 102 has a back panel 104, side panels 106 and 108, and a top panel 110. The cabinet 102 further has one or more shelves 112 coupled to the back panel 104 and both side panels 106 and 108. The number of shelves 112 and the spacing between shelves 112 is generally a matter of personal preference. The shelves 112 may also be adjustable in a manner familiar to those skilled in the art. Some of the shelves 112 may have an extending lip to keep items stored on the shelf 112 from sliding off. The cabinet 102 may further have doors. The doors would be used to cover the front opening in the cabinet 102.

The assembly 100 has a support panel 114. The support panel 114 is coupled to the wall from which the assembly 100 is to be mounted. The support panel may be mounted in any manner. Screws, nails, and the like may be used to secure the support panel to the wall. Additionally, in order to firmly secure the panel 114 to the wall, a securing mechanism 116 may be used. In accordance with one embodiment of the present invention, the securing mechanism 116 has a back board 118. A French cleat cut from the back board 118 fastens to the wall studs within the wall. The support panel 114 has an opening 120 cut through an upper section of the support panel. The opening 120 is for the French cleat cut from the back board 118. This will provide extra support in order to securely fasten the assembly 100 to the wall.

Conventional telescoping drawer glides 122 are used to couple the cabinet 102 to the support panel 114. Each of the glides 122 has a first portion 124 that is mounted to the support panel 114 and a second portion 126 which is mounted to the back panel 104 of the cabinet 102. If more than one glide is used, the glides should be mounted parallel to one another to allow the assembly 100 to smoothly extend and retract. One or more tension gas springs 128 are coupled both to the support panel 114 and to the cabinet 102. The tension gas spring is similar to that described in the previous embodiment and is similar coupled to the support panel 114 and to the cabinet 102. The gas spring 128 has a cylinder section 128A and a rod portion 128B that is mounted within the cylinder 128A and is extendable therefrom. The gas spring 128 is mounted to the back panel 104 and to the support panel 114 by a pin and U-bracket (See FIG. 6). Other type of brackets such as a post style bracket or an eye rod end may also be used. A U-shaped guide (See FIG. 7) is also mounted to the back panel 104 and is positioned to receive the gas spring 128. This U-shaped guide provides lateral stability to the gas spring 128.

When items are needed from the assembly 100, a handle on the cabinet 102 is grasped and the cabinet 102 is pulled down until the telescoping portions 126 of the glides 122 are fully extended. In this extended position, the shelves 112 in the cabinet 102 are easily accessible. The cabinet 102 will stay fully extended, until a light amount of upward pressure is applied to the cabinet 102. This will cause the rod portion of the tension gas springs 128 to retract to its original position. To avoid accidental retraction, caused by an inadvertent tap, a variety of latching devices can be used to hold the cabinet 102 in their extended position. Some of these latching devices were previously discussed above.

Though the cabinet contemplated by the present invention has been described with respect to a rectangular shaped cabinet, it should be appreciated by one skilled in the art that the invention is equally applicable to other shapes such as triangular or square.

Various modifications and alterations to the above-described preferred embodiment will be apparent to those skilled in the art. Accordingly, these descriptions of the invention should be considered exemplary and not as limiting the scope and spirit of the invention as set forth in the following claims.

What is claimed is:

1. A downward extendable and retractable shelving system comprising, in combination:

a cabinet;

a support panel coupled to a wall from which the system is to be mounted for mounting the cabinet to the wall; and an extendable and retractable mechanism coupled to the cabinet and to the support panel for lowering and raising the cabinet wherein the extendable and retractable mechanism comprises:

at least one tension gas spring coupled to the cabinet and the support panel for lowering and raising the cabinet wherein the tension gas spring has a cylinder portion and a rod portion mounted in the cylinder portion and extendable therefrom; and at least one drawer glide coupled to the cabinet and the support panel; and a U-shaped guide attached to the support panel and receiving the cylinder portion of the tension gas spring.

2. The system of claim 1 wherein the tension gas spring is coupled to the cabinet by a pin and U-bracket.

3. The system of claim 1 wherein the tension gas spring is coupled to the support panel by a pin and U-bracket.

4. The system of claim 1 wherein the at least one drawer glide comprises:

a first track section which is coupled to the support panel; and a second track section coupled to the cabinet and which slides within the first track section.

5. The system of claim 1 wherein the cabinet comprises:

a back panel;

a pair of side panels coupled to the back panel;

a top panel coupled to the back panel and the pair of side panels; and at least one shelf coupled to the back panel and the pair of side panels.

6. The system of claim 5 wherein the cabinet further comprises doors.

7. The system of claim 5 wherein the at least one shelf has an upward extending lip.

8. The system of claim 1 further comprising a handle coupled to the cabinet for pulling the cabinet to a lowered position.

9. A downward extendable and retractable shelving system comprising, in combination:

a cabinet;

a support panel coupled to a wall from which the system is to be mounted for mounting the cabinet to the wall; and an extendable and retractable mechanism coupled to the cabinet and to the support panel for lowering and raising the cabinet wherein the extendable and retractable mechanism comprises:

at least one tension gas spring coupled to the cabinet and the support panel for lowering and raising the cabinet wherein the tension gas spring has a cylinder portion and a rod portion mounted in the cylinder portion and extendable therefrom; and at least one drawer glide coupled to the cabinet and the support panel; and a U-shaped guide attached to the support panel and receiving the cylinder portion of the tension gas spring.

10. The system of claim 9 wherein the tension gas spring is coupled to the cabinet by a pin and U-bracket.

11. The system of claim 9 wherein the tension gas spring is coupled to the support panel by a pin and U-bracket.

12. The system of claim 9 wherein the at least one drawer glide comprises:

a first track section which is coupled to the support panel; and a second track section coupled to the cabinet and which slides within the first track section.

13. The system of claim 9 wherein the cabinet comprises:

a back panel;

a pair of side panels coupled to the back panel;

a top panel coupled to the back panel and the pair of side panels; and at least one shelf coupled to the back panel and the pair of side panels.

14. The system of claim 13 wherein the cabinet further comprises doors.

15. The system of claim 13 wherein the at least one shelf has an upward extending lip.

16. The system of claim 9 further comprising a handle coupled to the cabinet for pulling the cabinet to a lowered position.

* * * * *